US011724304B2

(12) United States Patent
Olsson

(10) Patent No.: US 11,724,304 B2
(45) **Date of Patent: *Aug. 15, 2023**

(54) HANDHELD HANDLE-POWERED PULL RIVETER

(71) Applicant: Goran Olsson, Carlsbad, CA (US)

(72) Inventor: Goran Olsson, Carlsbad, CA (US)

( * ) Notice: Subject to any disclaimer, the term of this patent is extended or adjusted under 35 U.S.C. 154(b) by 227 days.

This patent is subject to a terminal disclaimer.

(21) Appl. No.: 16/741,086

(22) Filed: Jan. 13, 2020

(65) Prior Publication Data

US 2020/0147672 A1 May 14, 2020

Related U.S. Application Data

(63) Continuation-in-part of application No. 15/554,412, filed as application No. PCT/US2016/060096 on Nov. 2, 2016, now Pat. No. 10,532,396.

(60) Provisional application No. 62/249,811, filed on Nov. 2, 2015.

(51) Int. Cl.

| | |
|---|---|
| ***B21J 15/06*** | (2006.01) |
| ***B21J 15/10*** | (2006.01) |
| ***B21J 15/20*** | (2006.01) |
| ***B21J 15/32*** | (2006.01) |
| ***B21J 15/18*** | (2006.01) |
| ***B21J 15/04*** | (2006.01) |

(52) U.S. Cl.

CPC ..... *B21J 15/06* (2013.01); *B21J 15/043* (2013.01); *B21J 15/105* (2013.01); *B21J 15/18* (2013.01); *B21J 15/20* (2013.01); *B21J 15/32* (2013.01)

(58) Field of Classification Search

CPC ..... B21J 15/043; B21J 15/06; B21J 15/105; B21J 15/18; B21J 15/20; B21J 15/32; Y10T 29/53739

USPC ..... 29/243.523

See application file for complete search history.

(56) References Cited

U.S. PATENT DOCUMENTS

| | | | | |
|---|---|---|---|---|
| 3,616,673 | A * | 11/1971 | Miklos | B21J 15/105 29/798 |
| 3,898,833 | A * | 8/1975 | Richardson | B21J 15/105 29/243.525 |
| 6,418,599 | B2 * | 7/2002 | Suzuki | B21J 15/043 29/243.523 |
| 6,588,246 | B2 * | 7/2003 | Ko | B21J 15/043 29/243.528 |
| 7,159,290 | B1 * | 1/2007 | Liu | B21J 15/205 29/243.523 |
| 7,159,291 | B2 * | 1/2007 | Ohuchi | B21J 15/323 72/391.6 |
| 8,402,807 | B2 * | 3/2013 | Zhou | B21J 15/18 72/391.6 |

(Continued)

FOREIGN PATENT DOCUMENTS

| | | | | |
|---|---|---|---|---|
| CN | 201862729 U | * | 6/2011 | B21J 15/043 |
| DE | 20218447 U1 | * | 4/2004 | B21J 15/043 |

(Continued)

*Primary Examiner* — Shelley M Self
*Assistant Examiner* — Jared O Brown
(74) *Attorney, Agent, or Firm* — Donn K. Harms

(57) ABSTRACT

A blind riveting device is provided, which is adapted for engagement to a handle having a powered translating member projecting therefrom. Force from the translating member imparted to a drive piston moves a second piston to pull a blind rivet connected to a jaw engaged with the second piston, thereby mounting the blind rivet.

9 Claims, 4 Drawing Sheets

(56) References Cited

U.S. PATENT DOCUMENTS 10,532,396 B2 * 1/2020 Olsson ..... B21J 15/26

FOREIGN PATENT DOCUMENTS

| | | | | | |
|---|---|---|---|---|---|
| DE | 202013104109 | U1 * | 12/2014 | ..... | B21J 15/105 |
| DE | 102011123106 | B3 * | 6/2020 | ..... | B21J 15/20 |
| EP | 2564949 | A2 * | 3/2013 | ..... | B21J 15/326 |
| EP | 2565469 | A2 * | 3/2013 | ..... | B21J 15/105 |
| KR | 200349914 | Y1 * | 5/2004 | ..... | B21J 15/043 |

* cited by examiner

HANDHELD HANDLE-POWERED PULL RIVETER

This application is a Continuation in Part to U.S. patent application Ser. No. 15/554,412 filed on Aug. 29, 2017 which claims priority to U.S. Provisional Patent Application Ser. No. 62/249,811 filed on Nov. 2, 2015, both of which are included herein in their entirety by this reference thereto.

1. FIELD OF THE INVENTION

The present invention relates generally to tools such as riveters. More particularly, the disclosed device relates to a handheld pull or pop riveting device, which employs an onboard fluid supply to power and provide reverse translation of a drive piston with sufficient torque to compress and install a pull rivet using only a hand-held drive to power a drive piston which in turn communicates the fluid to secondary piston and achieve sufficient mechanical advantage to install a pull or pop rivet.

2. PRIOR ART

Blind rivets, commonly referred to as "pop" rivets are tubular in configuration and are supplied with a mandrel through a center axis of the rivet. Such blind rivets are used throughout the world as connectors between to overlapping adjacent surfaces when a permanent and secure compressive engagement is desired.

In use, the blind rivet assembly is inserted into a hole drilled through the adjacent parts or surfaces to be permanently joined. Thereafter, a specially designed pulling tool is used to draw the mandrel into the rivet. The translation of the mandrel along the rivet axis expands the blind end of the rivet. At a predetermined point of expansion and compression of the rivet and the joined surfaces, the force of the installation tool will break or snap the mandrel off of the rivet structure. The rivet is at this point permanently engaged in a compressive fit between the two surfaces being joined.

Unlike solid rivets, such as are used in ships or building bridges, blind rivets can be inserted and fully installed in a joint from only one side of a part or structure, or "blind" to the opposite side. Due to this feature, blind rivets are employed in situations where access to the joint is easily available from only one side.

In use, a blind rivet is placed in a drilled hole. Once properly situated, the rivet is permanently set by pulling the mandrel head into the rivet body while concurrently forcing the rivet against the surface surrounding the drilled hole. The compression of the rivet requires considerable force as the translation of the mandrel into the body expands the rivet body in the hole, causing it to flare against the reverse side. As the head of the mandrel reaches the face of the blind side of the rivet body, the pulling force is resisted, and at a predetermined force, the mandrel snaps at its break point, also called blind setting. In this fashion, a tight joint is formed by the rivet body within the hole and the head of the mandrel remains encapsulated at the blind side. Of course those skilled in the art will realize that variations of such blind or pop rivets are available. In all modes, the mandrel stem is ejected once broken from the rivet structure at a score or weakened point adapted to break at a predetermined force.

Currently, due to the force required to pull the mandrel, compress the body of the rivet, and then break the metal mandrel from the rivet body, cumbersome mechanical installation tools, and hydraulically powered rivet installation tools are widely used.

In the case of hydraulically powered tools, such are connected by a hose to a fluid supply such as oil or hydraulic fluid or pressurized air flowing under pressure from a pump. This renders such rivet installing tools especially cumbersome due to the heavy hose required to resist bursting from fluid pressure, as well as having to constantly readjust the hose positioning during use of the tool to install the rivet.

Further, such cumbersome hoses and the like limit use of such hydraulically powered rivet tools to locales where there exists electrically powered or mechanically powered large hydraulic pumps to provide the fluid flowing under pressure through the hose to the tool. Absent the ability to employ a powered tool, users are left with cumbersome human-powered mechanical devices which because of the levers required for mechanical advantage, are hard to operate and can easily mis-mount such rivets due to mis-positioning during the use of the long lever required.

The disclosed device herein provides a handheld rivet installation tool which operates internally to employ hydraulic force for significant mechanical advantage during operation, but requires no cumbersome cords, hoses or connections to pumps.

The forgoing examples of related art and limitation related therewith are intended to be illustrative and not exclusive, and they do not imply any limitations on the invention described and claimed herein. Various limitations of the related art will become apparent to those skilled in the art upon a reading and understanding of the specification below and the accompanying drawings.

SUMMARY OF THE INVENTION

The device herein disclosed and described provides a solution to the shortcomings in prior art and achieves the above noted goals through the provision a blind or pop rivet installation tool, which is easy to use, and provides the user with significant mechanical advantage for the required pulling of the mandrel of such blind rivets. Employing an onboard hydraulic system, the device provides the mechanical advantage to exert the significant force to pull and compress a blind rivet, and to snap the mandrel in a compact device which requires no hoses or cords, or the like, which as noted render prior art tools awkward to use and limit locales for such use. Instead the device uses the translating member of existing battery powered handheld devices for engaging grommets or rivets such as the PR-5 Riveter from PROSPOT Quality Welding Systems of Carlsbad, Calif., and similar handheld battery powered devices which translate a member under force to exert force to grommets and rivets and the like using dies which compress them to a fixed engagement.

The device features a tool having a coupling at a first end of a drive cylinder, which is adapted for engagement with the translating member of a housing or handle having a battery powered drive which is widely employed for fixing grommets and conventional rivets using two sided force. Once in operative engagement with the threaded translating member from the powered handle, activation thereof will initiate the drive in the handle to translate the powered member of the drive handle, to move a drive piston which is axially positioned within the drive cylinder. Movement of the drive piston of the device forces an onboard fluid supply, held in the device herein, under pressure, through a pivoting engagement to a secondary cylinder which axially houses a secondary piston.

The fluid communicated from the drive cylinder to translate the secondary piston may communicate through a pathway running through a pivot engaged between the secondary cylinder and the drive cylinder running in the drive housing. This pivot allows for a pivoting engagement between the drive cylinder and secondary cylinder. A secondary pivot may also be positioned to allow a horizontal rotation of the secondary cylinder housing as well as a third pivoting engagement with the drive component or handle.

The translation of the secondary piston is in a reverse direction to the axial translation of the drive piston within the drive cylinder. This is preferred, as it allows for a compact configuration of the handle engageable tool device herein, when engaged to the handle, while exerting the force to mount a pop rivet or blind rivet requiring force in this direction.

In operation, a powered translation of the drive piston, by translation of a drive member from the battery powered handle engaged to the device, moves the drive piston within the drive housing toward a nose of the secondary cylinder. Movement of this drive piston will cause a translation of the second cylinder in a reverse direction or in a direction away from the nose of the second cylinder housing the secondary piston.

A mandrel grip jaw on the proximal end of the secondary cylinder, when engaged to the mandrel of a hidden rivet, will thus operate under the considerable mechanical advantage provided by the electric powered handle translating member to the drive piston to the second cylinder, to easily pull the mandrel to mount the rivet and subsequently detach the mandrel. Blind rivet mandrels break at a predetermined force and thereafter the detached mandrels are deposited within a collection cavity engaged to a first end of the second cylinder housing the secondary piston. Alternatively, the detached mandrels simply fall from the front of the device where the collection cavity is not provided for a more compact device.

A biasing means such as a spring, engaged with the secondary piston within the secondary cylinder, causes the secondary piston to translate toward the nose of the second cylinder once the drive force from the translating member of the battery powered handle ceases and moves in a reverse direction. This causes a concurrent return of oil or fluid from the second cylinder through the pivot to the drive cylinder whereafter the process may be repeated.

With respect to the above description, before explaining at least one preferred embodiment of the herein disclosed handheld rivet tool device in detail, it is to be understood that the invention is not limited in its application to the details of construction and to the arrangement of the components or steps noted in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other devices for engaging hidden rivets, and methods and systems for carrying out the several purposes of the present disclosed device. It is important, therefore, that the claims herein be regarded as including such equivalent construction and methodology insofar as they do not depart from the spirit and scope of the present invention.

It is an object of this invention to provide a compact and power assisted tool to engage blind rivets which requires no air or hydraulic hoses or power.

It is a further object of this invention to provide such a blind rivet engaging tool which will engage to any battery powered housing or handle having a powered translating member which is employed to mount rivets and grommets using a compression housing and dies.

The objects, features, and advantages of the present invention, as well as the advantages thereof over existing prior art, which will become apparent from the description to follow, are accomplished by the improvements described in this specification and hereinafter described in the following detailed description which fully discloses the invention, but should not be considered as placing any limitations whatsoever thereon.

BRIEF DESCRIPTION OF DRAWING FIGURES

The accompanying drawings, which are incorporated herein and form a part of the specification, illustrate some, but not the only or exclusive, examples of embodiments and/or features. It is intended that the embodiments and figures disclosed herein are to be considered illustrative, rather than limiting.

Figure 1:
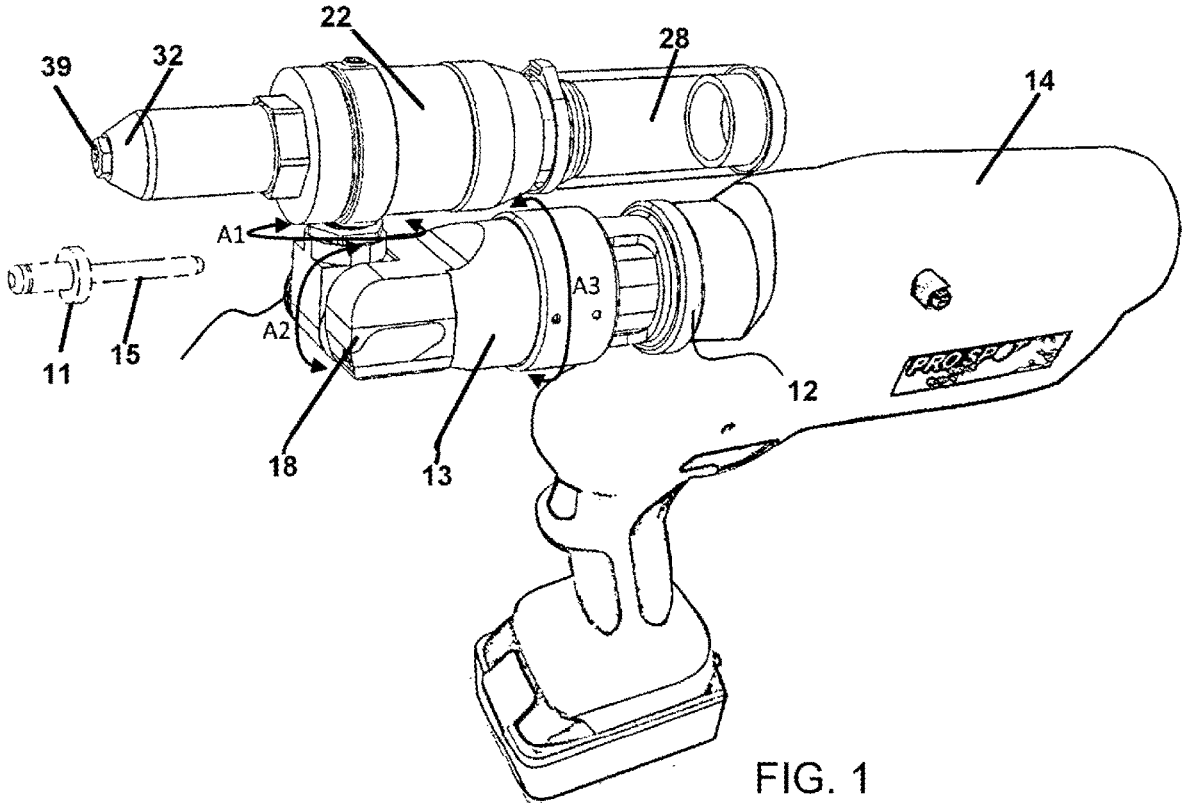
FIG. 1 depicts the blind rivet tool device herein, having a coupling at a first end adapted for operative engagement with a translating member within a housing of a battery powered housing or handle drive which is engageable to provide powered translation of the drive piston.

Other aspects of the present handheld handle-powered pull riveter shall be more readily understood when considered in conjunction with the accompanying drawings, and the following detailed description, neither of which should be considered limiting.

DETAILED DESCRIPTION OF THE PREFERRED EMBODIMENTS OF THE INVENTION

In this description, the directional prepositions of up, upwardly, down, downwardly, front, back, top, upper, bottom, lower, left, right and other such terms refer to the device as it is oriented and appears in the drawings and are used for convenience only. Any such terms are not intended to be limiting or to imply that the device has to be used or positioned in any particular orientation.

Now referring to drawings in FIGS. 1-8, there is seen in FIG. 1 the rivet tool device 10 herein, operatively engaged at a coupling 12 at a first end of a drive cylinder 13 in operative removable engagement with a housing or a handle 14 having an internal drive adapted impart a powered translation of a member 19 to a drive piston 16 axially translating within the drive cylinder 13. The handle 14 may be provided as part of an assembled device 10, or in the preferred mode of the device 10, the device 10 can be configured with a coupling 12 adapted to engage any handle 14 or drive component, in an operative removable engagement which positions a powered translation of a drive member 19 or 19*a* (FIGS. 4-6 for example) to communicate force to the drive piston 16 once so engaged.

Figure 2:
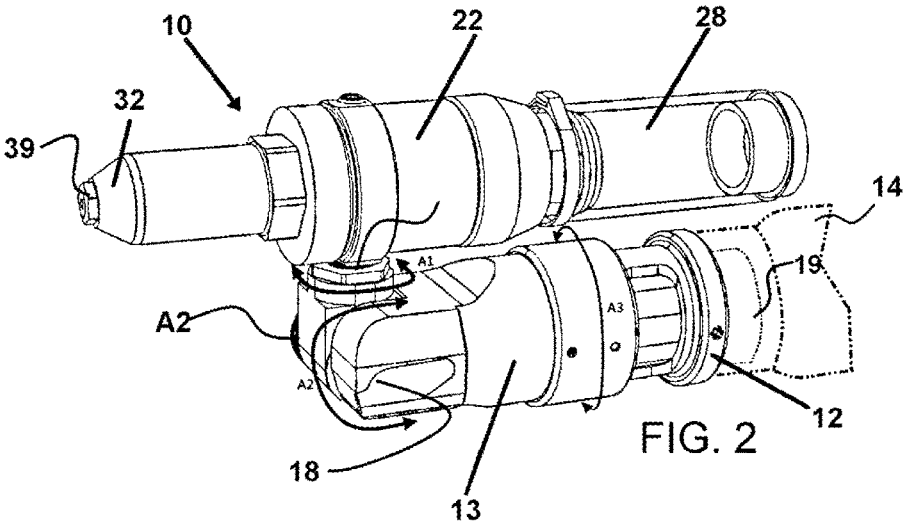
FIG. 2 is a perspective view of the rivet tool device herein of FIG. 1, disengaged from the threaded translating member of a drive handle and configured for operative removable engagement to the threaded translating member of a drive handle at a coupling.
Figure 3:
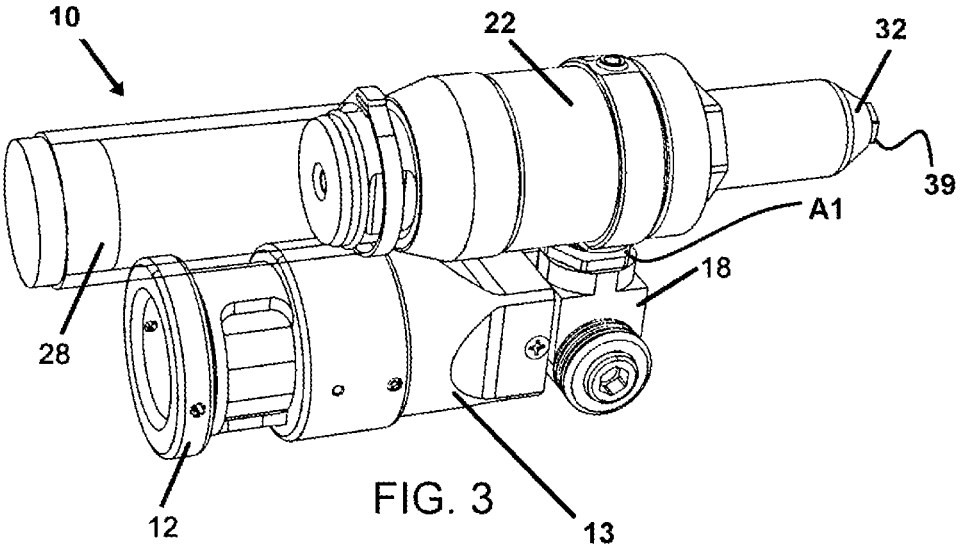
FIG. 3 depicts a perspective view opposite that of FIG. 2.

FIG. 2 shows a perspective view of the rivet tool device 10 of FIG. 1, disengaged from a drive component or drive handle 14. The coupling 12 is configured for operative removable engagement to a drive handle 14 as in FIG. 1, or another drive handle 14 having the mechanical member 19 or 19*a* driven by a power such as an electric motor, to contact against and translate the drive piston 16 in a direction axially away from the coupling 12 and toward a pivot 18, or a second end of the drive cylinder 13 opposite the first end thereof at the coupling 12. The device 10 of FIG. 2 is shown in FIG. 3 from an opposite side view.

Figure 4:
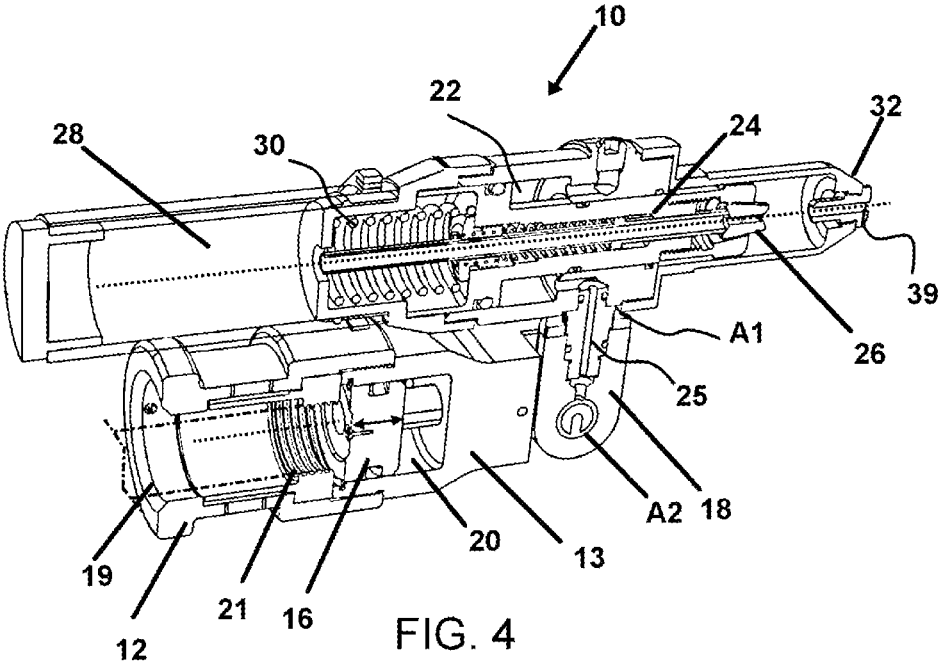
FIG. 4 is a sectional view through the device as depicted in FIG. 3 showing the components.
Figure 5:
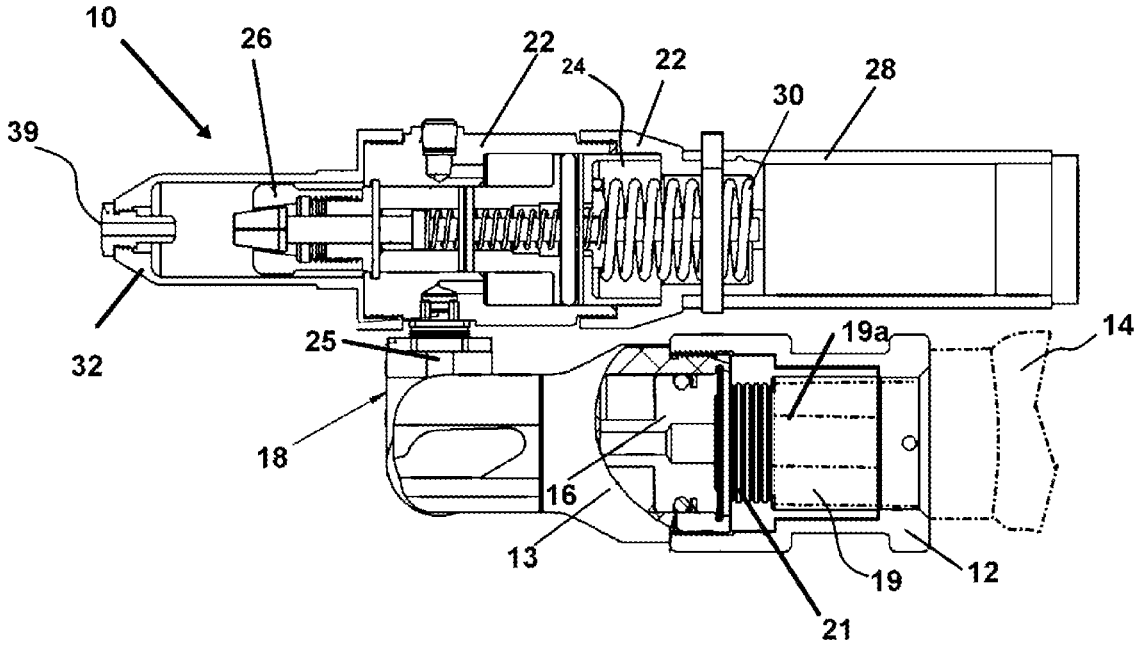
FIG. 5 depicts a sectional view of the device of FIGS. 3 and 4, in a reversed positioning.

Also shown in FIGS. 4-5, can be seen the coupling 12 at a first end of the drive cylinder 13, with the device 10 having the axially engaged drive piston 16. Translation of the drive piston 16 by a translating member 19 or 19*a* (FIGS. 4-6) emanating from an operatively engaged powered handle 14, pushes the drive piston 16 toward the pivot 18 under force generated by the motor or other drive mechanism of the handle 14. This translation also forces fluid through a fluid passage or fluid cavity 20, such as from fluid running in passages 25 through a pivot 18 (A2), and then into the second cylinder 22, as can be seen in FIG. 5 or 7.

The fluid under pressure from the drive cylinder 13 through the fluid passage or fluid cavity 20, communicates against the second piston 24. The fluid communicated against the second piston 24, forces the second piston 24 to translate in a direction toward the first end of the second cylinder 22, within its axial sliding engagement in the second cylinder 22, in a direction opposite that of the translation of the drive piston 16 within the drive cylinder 13.

Of course other devices may, upon reading this disclosure, use a two piston system with onboard hydraulics, with different translation directions of pistons and such is anticipated within the scope of this invention. Any tool which is adapted to engage a powered handle 14 and place a translating member 19 or 19*a* in contact with a drive piston 16 which communicates fluidly to translate a second piston 24 to install a blind rivet 11, no matter the direction of translation, may be employed. However, the opposing direction of the drive piston 16 and the second piston 24 during experimentation yielded the most compact configuration of the device 10, which is particularly preferred in the device 10 herein, since such devices 10 are employed in tight spaces to engage blind rivets 11 and the like where compactness makes use easier.

This translation of the second piston 24 toward the first end of the second cylinder 22 of the device 10 with coupling 12, with a mandrel 15 operatively engaged with a jaw 26 at a distal end of, or connected to the second piston 24, under the force provided by the significant mechanical advantage of the pressurized fluid acting against the second piston 24, causes the mandrel 15 to compress the hidden rivet 11.

The mandrel 15 will subsequently detach therefrom at a calculated force which is determined at manufacture by a weakening or break point on the mandrel 15 in a conventional fashion. During this detachment, the broken portion of the mandrel 15 either communicates through an axial passage of the second piston 24 and is deposited into a collection cavity 28 removably engaged with a first end of the second cylinder 22, or it may simply eject or drop from the opening or aperture 39 at the nose 32 located at the second end of the second cylinder 22, in the mode of the device 10 of FIGS. 6-8.

A biasing component such as a spring 30 acts to bias the second piston 24 in a direction toward the nose 32, located at the second end of the second cylinder 22 opposite a first end of the second cylinder 22. As noted, this biasing component will cause the second piston 24 to translate back toward the nose 32 once the force from fluid communicated through passages from the translated drive piston 16 ceases. Such will cause the fluid flow to reverse within the passages device 10, and thereby translate the drive piston 16 back toward the coupling 12 at the first end of the drive cylinder 13.

Operation of a drive handle 14, having a powered translating member 19 or 19*a* operatively engaged against the drive piston 16, will reverse the flow of fluid through the fluid cavity 20 from the force of the biasing means or spring 30 as noted above, when concurrently translating the drive piston 16 toward the pivot 18 at the second end of the drive cylinder 13. As noted also, this, in turn, will cause the second piston 24 to translate in an opposite direction toward the second end of the second cylinder 22, which as noted is preferred herein to allow for a more compact device 10 which is easier to employ when engaged to a handle 14 and used in tight spaces. As can be seen by those skilled in the art, appropriate valving and fluid passages 20 are operatively positioned within the device 10 for this two-way fluid passage and hydraulic action producing mechanical advantage.

Figure 6:
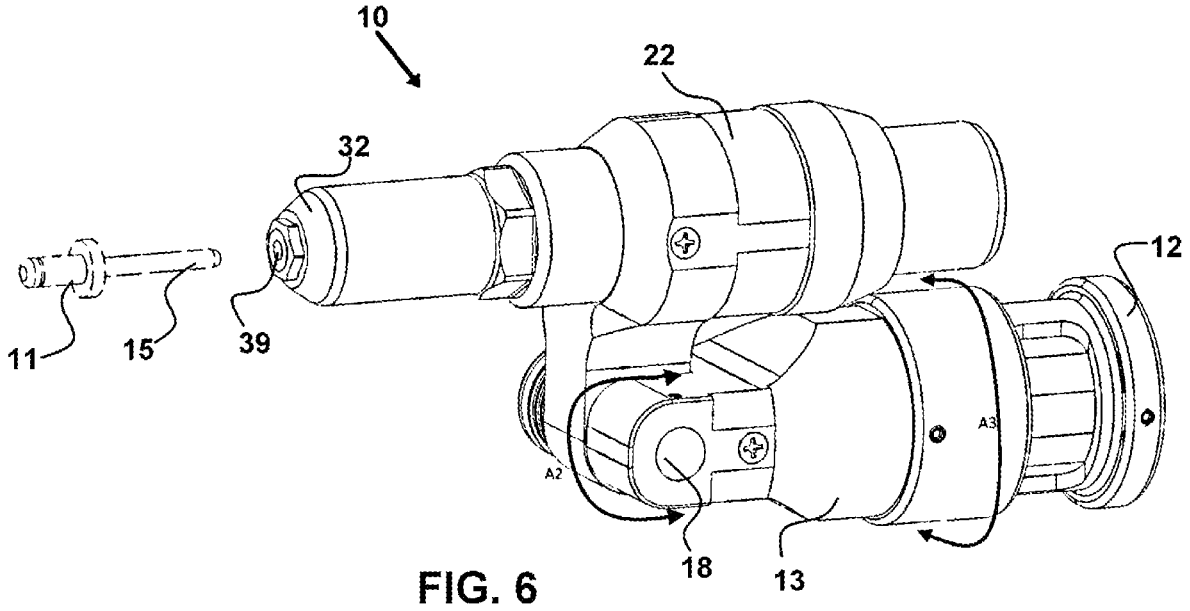
FIG. 6 shows another preferred mode of the device herein, wherein the mandrel collection is removed to yield a more compact unit.
Figure 7:
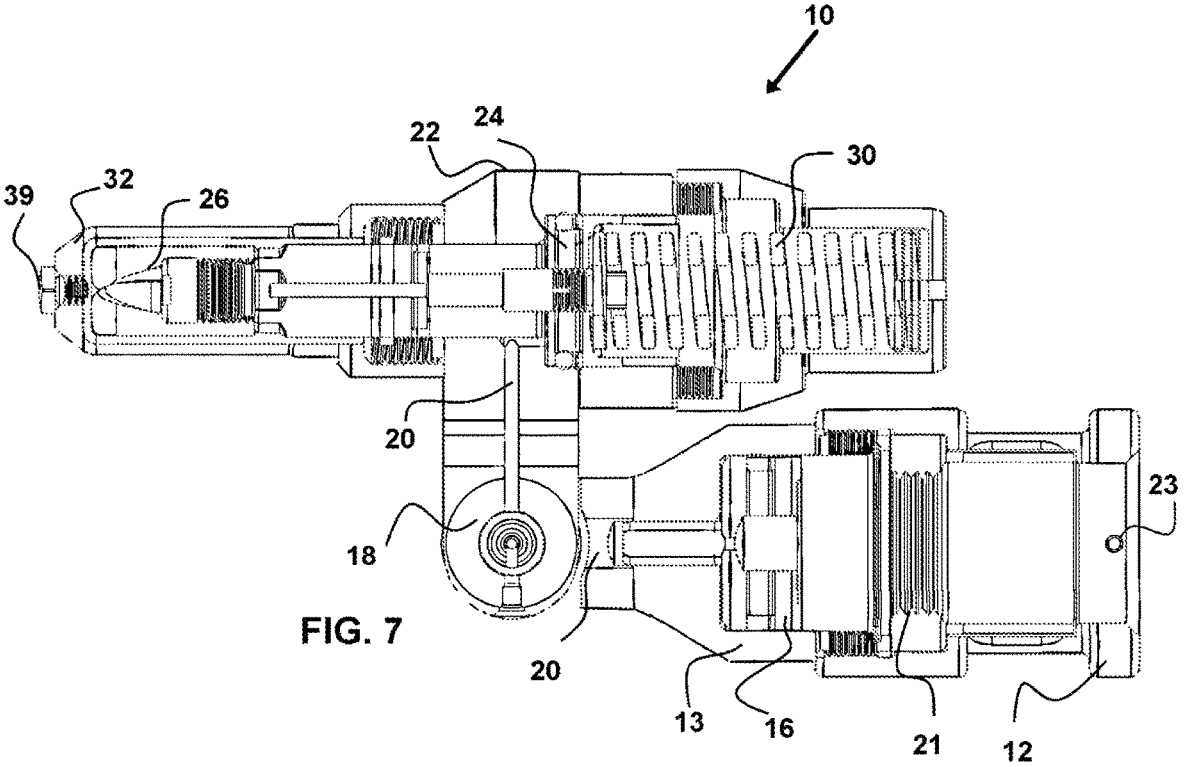
FIG. 7 is a sectional view through the mode of the device of FIG. 7, which functions in the same fashion as the device of FIGS. 1-4 but ejects the disengaged mandrels.

FIGS. 6-7 shows another preferred mode of the device 10 herein, wherein the detached mandrel 15 collection cavity 28 is removed to yield a more compact device 10. This mode of the device 10 functions essentially the same, as noted above, wherein coupling 12 at a first end of the drive cylinder 13 is adapted for removable engagement with a handle 14 having a translating member portion 19*a* of the member 19 of the handle 14 operatively posited to engage against the drive piston 16. If the handle 14 is connected with the coupling 12 in a fixed removable engagement such as with a set screw 23 or the like, the entire member 19 might translate in other modes.

The overriding factor in all modes of the device 10 is that the first end of the drive cylinder 13 is adapted to form an engagement with a powered handle 14, where such adapted engagement allows for force from the distal end of a translating member 19 or 19*a* to contact and force the drive piston 16 toward the second end of the drive cylinder 13, without disengagement of the handle 14 from a fixed but removable position against the first end of the drive cylinder 13, such as with the coupling 12.

The drive piston 16, as shown in the mode of the device 10 of FIGS. 6-7, is adapted at a first end, as with other modes of the device 10 herein, for a removable engagement with a member 19 such as with threads 21 which cooperative engaged threads on the translating member 19 projecting from the handle 14 used herewith which surrounds a coaxial translating portion 19*a* member 19.

Translation of the drive piston 16 by the translating portion 19*a* of the member 19 from the handle 14 so removably engaged, pushes the drive piston 16 toward the pivot 18 at the second end of the drive cylinder 13, where the pivot 18 (A2) allows the second cylinder 22 housing to rotate vertically inline with the axis of the drive cylinder 13 shown in FIG. 4.

This translation of the drive piston 16 from the force from the member emanating from the engaged handle 14, as in other modes of the device 10, forces fluid within a fluid cavity 20, into the second cylinder 22 to an operative communication against the second piston 24. This fluid communicated against the second piston 24, forces the second piston 24 to translate in a direction toward the first end of the second cylinder, within its axial sliding engagement in the second cylinder 22, in a direction opposite that of the translation of the drive piston 16 within the drive cylinder 13.

This rearward translation of the second piston 24 toward the first end of the second cylinder 22, with a mandrel 15 operatively engaged with a jaw 26 connected to a distal end of the second piston 24, under the force provided by the significant mechanical advantage of the pressurized fluid acting against the second piston 24, causes the mandrel 15 to compress the hidden rivet 11, and subsequently detach therefrom. During detachment, the broken portion of the mandrel 15, in the mode of the device 10 of FIGS. 6-7, simply ejects or drops from the jaw 26 and falls through an aperture 39 at the nose 32.

A biasing component such as a spring 30 acts to bias the second piston 24 in a direction toward the jaw 26 and a nose 32, located at a second end of the second cylinder 22. As noted, this biasing component will force the second piston 24 to translate back toward the nose 32 once the force from the translated drive piston 16 ceases, and will cause the fluid flow to reverse within the device 10, and thereby translate the drive piston 16 back toward the coupling 12.

Operation of a drive handle 14 having a powered translating member portion 19*a* or member 19 operatively engaged with the drive piston 16 within the coupling 12, in a reverse direction, may also aid in the reverse flow of fluid through passages which concurrently translates the drive piston 16 away from the pivot 18 at the second end of the drive cylinder 13.

The device 10, in all modes, thus allows for installation of hidden or pop rivets 11 and the like, using only the device 10 which is adapted to be operatively removably engaged with a handle 14 having a translating member 19 or member portion 19*a* which is forced under power by the battery powered handle 14, to impart force against the drive cylinder 16 and translate the drive cylinder 16 as described above. One such operative connection is using member 19 which surrounds a translating member portion 19*a*, where the member has threads 21. Another is to employ a connection to the handle 14 at the coupling 12 and translate a member 19 or member portion 19*a*.

The device 10 can be adapted to engage any handle 12 with a translating member 19 or member portion 19*a* or both, such that a force from translation from a motor or power source in the handle 14, moves the drive piston 16 herein in the manner noted, and the engagements herein should not be viewed as limiting.

As noted, such battery powered handles 14 are widely employed for compression of rivets and grommets using opposing dies which crush the grommet or rivet to a mount as the translating member of the handle 14 moves in a direction away from the grip. The need for hoses or cords or other tethered means for communication of power is eliminated, allowing the compact device 10 to be more easily employed and to be used in locales without power or pressurized fluid connections.

A first rotating or pivoting engagement A2 at a pivot 18, may be preferable to allow the second cylinder 22 to pivot or rotate inline with a plane running along the axis of the drive cylinder 13, to allow for positioning of blind rivets 11 in tight spaces. Further, a second rotating or pivot 18 engagement shown at A3 is preferably located at the coupling 12 where the drive piston 16 or connection to the member 19, allows rotation of the device 10 around a drive cylinder axis shown in FIG. 4. Further, a third pivot 18 shown as A1 as depicted in FIGS. 1-2, can be provided to allow a rotation of the second cylinder 22 in a plane overhead of the drive cylinder 13 and parallel to the axis of the drive cylinder 13.

In a pivoting mode of the device 10, the first pivoting engagement A2 of the second cylinder with the drive cylinder 13 is preferred as is the second rotating or pivoting engagement A3 of the drive cylinder 13 with the coupling 12 to allow rotation around the axis of the drive cylinder 13. This aids use in tight spaces. The third pivoting engagement A1, is optional but may be preferable for a user working in extremely tight spaces.

Figure 8:
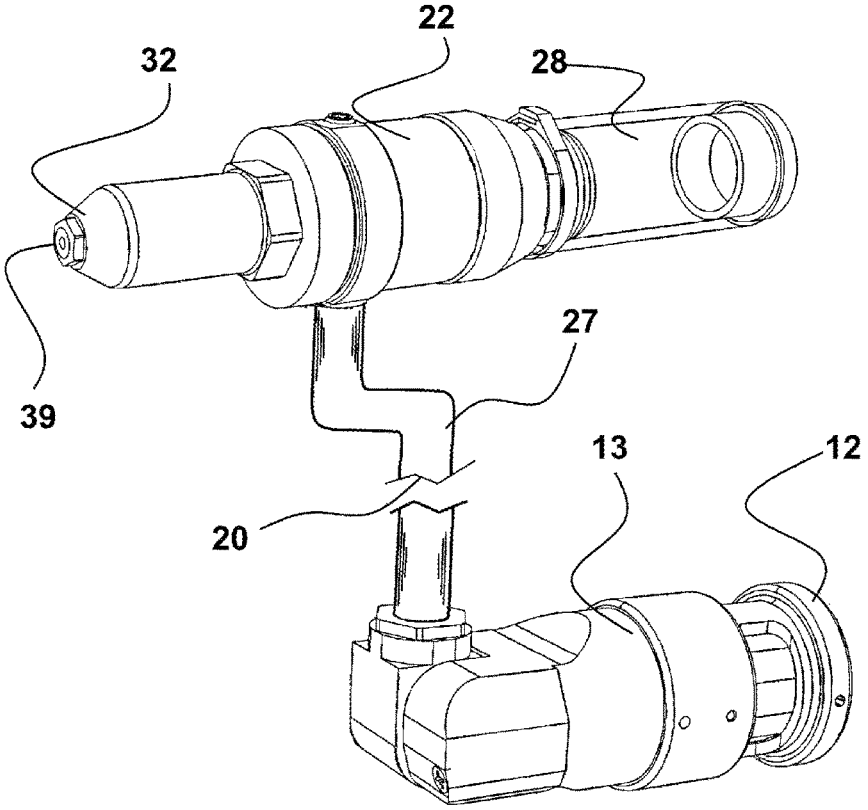
FIG. 8 depicts the device which operates in the same fashion as that of FIGS. 1-7 wherein pressurized fluid from the drive cylinder to the second cylinder runs through the fluid cavity in a flexible conduit in a sealed engagement between the drive cylinder and the second cylinder.

Shown in FIG. 8 is the device 10 herein, which operates in the same fashion as that described above for FIGS. 1-7 wherein pressurized fluid from the drive cylinder 13, is communicated through a fluid cavity 20 to the second cylinder 22. As shown in FIG. 8, the fluid cavity 20 runs axially through the channel within a flexible conduit 27 in a sealed engagement between the drive cylinder 13 and the second cylinder 22.

As with the device of FIGS. 1-7 and shown therein, a coupling 12 at a first end of the drive cylinder 13, is adapted for removable engagement with a handle 14 such as in FIG. 1. In the same fashion as noted above, a force from translation from a motor or power source in the handle 14, moves a drive piston 16 in the drive cylinder 13 to communicate pressurized fluid to and through the fluid cavity 20 to the second cylinder 22.

In the same fashion as described above and shown in FIGS. 5 and 7, the fluid from the fluid cavity 20 is communicated into the second cylinder 22 and against the second piston 24. This forces the second piston 24 to translate in a direction toward the first end of the second cylinder 22, within its axial sliding engagement in the second cylinder 22, in a direction opposite that of the translation of the drive piston 16 within the drive cylinder 13.

As noted above, and shown in FIG. 5, this rearward translation of the second piston 24 toward the first end of the second cylinder 22, with a mandrel 15 operatively engaged with a jaw 26 connected to a distal end of the second piston 24, causes the mandrel 15 to compress the hidden rivet 11, and subsequently detach therefrom. During detachment, the broken portion of the mandrel 15, in the mode of the device 10 of FIGS. 6-7, simply ejects or drops from the jaw 26 and falls through an aperture 39 at the nose 32.

While all of the fundamental characteristics and features of the handle engageable rivet tool herein, have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

What is claimed is:

1. A blind riveting apparatus, comprising:

a drive cylinder having a first end opposite a second end and having a drive cylinder axis;

a drive piston translatable within said drive cylinder;

a second cylinder having a first end and having a second end opposite said first end, and having a second cylinder axis running therebetween;

said drive cylinder in a connection to said second cylinder;

a second piston translatable within said second cylinder between a first position and a second position, along said second cylinder axis;

said second end of said second cylinder having an aperture for positioning a blind rivet therein;

a jaw engaged with said second piston, said jaw for positioning a mandrel of said blind rivet within the aperture;

a fluid passage communicating between said drive cylinder to said second cylinder;

said fluid passage running within a flexible conduit having a first end thereof engaged with said drive cylinder and having a second end thereof engaged with said second cylinder;

translation of said drive piston in a first direction, toward said second end of said drive cylinder forcing a fluid held in said drive cylinder through said fluid passage in a first fluid direction and into said second cylinder;

said fluid entering said second cylinder from said fluid passage causing said second piston to translate from said first position to said second position thereof;

said second piston biased toward said first position thereof;

a coupling at said first end of said drive cylinder, said coupling for forming a removable engagement between said drive cylinder and said handle, said handle having a powered drive member therein; and whereby, with said drive cylinder in said engagement with said handle, a translation of said drive member therein against said drive piston moves said drive piston in said drive cylinder in said first direction thereof.

2. The blind riveting apparatus of claim 1, wherein said first direction of translation of said drive piston runs opposite to said second direction of said second piston.

3. The blind riveting apparatus of claim 1, wherein said connection of said first end of said flexible conduit to said drive cylinder is a pivoting engagement therebetween.

4. The blind riveting apparatus of claim 1, additionally comprising:

said engagement between said first end of said drive cylinder and said handle is a pivoting engagement therebetween.

5. The blind riveting apparatus of claim 2, additionally comprising:

said engagement between said first end of said drive cylinder and said handle is a pivoting engagement therebetween.

6. The blind riveting apparatus of claim 3, additionally comprising:

said engagement between said first end of said drive cylinder and said handle is a pivoting engagement therebetween.

7. A blind riveting apparatus, comprising:

a drive cylinder having a first end opposite a second end and having a drive cylinder axis;

a drive piston translatable within said drive cylinder;

a second cylinder having a first end and having a second end opposite said first end, and having a second cylinder axis running therebetween;

said drive cylinder in a connection to said second cylinder;

a second piston translatable within said second cylinder between a first position and a second position, along said second cylinder axis, said second piston biased toward said first position thereof;

said second end of said second cylinder having an aperture for positioning a mandrel of a blind rivet therein;

a jaw engaged with said second piston, said jaw for positioning said mandrel therein;

a fluid passage communicating between said drive cylinder to said second cylinder;

translation of said drive piston in a first direction, toward said second end of said drive cylinder forcing a fluid held therein, through said fluid passage in a first fluid direction and into said second cylinder;

said fluid entering said second cylinder translating said second piston from said first position to said second position thereof;

a coupling at said first end of said drive cylinder, said coupling for forming an engagement of said drive cylinder with a handle having a powered drive member therein; and whereby, with said drive cylinder in said engagement with said handle, a translation of said drive member in a contact against said drive piston moves said drive piston in said first direction thereof.

8. The blind riveting apparatus of claim 7, additionally comprising:

said connection of said drive cylinder engaged to said second cylinder being a first pivoting engagement; and said second cylinder rotatable on said first pivoting engagement along a line running parallel to said drive cylinder axis.

9. The blind riveting apparatus of claim 7, additionally comprising:

said engagement of said drive cylinder with said handle being a second pivoting engagement, said handle rotatable on said second pivoting engagement in a direction around said axis of said drive cylinder.

* * * * *